United States Patent [19]

Barnes

[11] Patent Number: 4,729,355

[45] Date of Patent: Mar. 8, 1988

[54] ENGINE PROTECTION DEVICE

[76] Inventor: Richard W. Barnes, 301 N. 67th Ave., Hollywood, Fla. 33024

[21] Appl. No.: 905,282

[22] Filed: Sep. 8, 1986

[51] Int. Cl.[4] ..... F02D 17/04

[52] U.S. Cl. ..... 123/342; 123/19 ED

[58] Field of Search ..... 123/342, 19 ED

[56] References Cited

U.S. PATENT DOCUMENTS

| | | | |
|---|---|---|---|
| 3,923,020 | 12/1975 | Gilligan | 123/342 |
| 4,126,114 | 11/1978 | Davis | 123/19 ED |
| 4,337,743 | 7/1982 | Mattson | 123/342 |
| 4,399,785 | 8/1983 | Mills | 123/19 ED |
| 4,485,781 | 12/1984 | Barnes | 123/342 |
| 4,526,140 | 7/1985 | Monigold et al. | 123/19 ED |

FOREIGN PATENT DOCUMENTS

| | | | |
|---|---|---|---|
| 211735 | 11/1984 | Japan | 123/342 |

*Primary Examiner*—William A. Cuchlinski, Jr.
*Attorney, Agent, or Firm*—Malin, Haley & McHale

[57] ABSTRACT

This is an improved engine protection device that allows activation of the engine protection device a selected oil pressure and to provide a close pressure for downshifting or shut down to idle. Further, the system may be used to also control the engine speed due to cooling water conditions. The improved device includes an oil pressure regulator having a fluid release system including a reduced pressure feed back system to vary the return pressure to a higher pressure after initial operation at a lower pressure.

3 Claims, 2 Drawing Figures

ENGINE PROTECTION DEVICE

BACKGROUND OF THE INVENTION

Existing internal combustion devices promote engine shut-down in the event of a failure in engine oil pressure, as shown in U.S. Pat. No. 4,080,946. The engine shut-down function results in a complete shut-down which requires a repriming of the fuel system before the vehicle can be moved by its own power. Additionally, such engine shut-down systems require valves, switches, gauges, relays and coils. These component ports are subject to corrosion and malfunction which results in a inoperative system. The inventor's prior invention provided an engine protection system that will allow the engine to idle allowing the operator to move the vehicle out of traffic patterns. The present invention provides a fluid or air pressure activated cylinder in series with the engine throttle rod to mechanically vary the length of the engine throttle rod or cable to limit the Available engine speed. The prior system did not allow quick response at one pressure to provide air or oil pressure and a quick shut down to idle at a shift pressure close to said one pressure. The present improvement invention provide an improved control system.

BRIEF DESCRIPTION OF THE INVENTION

This is an improved engine protection device that allows activation of the engine protection device a selected oil pressure and to provide a close pressure for downshifting or shut down to idle. Further, the system may be used to also control the engine speed due to cooling water conditions. The improved device includes an oil pressure regulator having a fluid release system including a reduced pressure feed back system to vary the return pressure to a higher pressure after initial operation at a lower pressure.

It is an object of this invention to provide an engine protection device which includes a fluid or air pressure activated cylinder interposed in series in the engine throttle rod operative to mechanically vary its effective length to limit the available engine speed by a quick initial turn on response and a quick response at a close pressure to the initial turn on pressure.

The instant invention has been shown and described herein in what is considered to be the most practical and preferred embodiment. It is recognized, however, that departures may be made therefrom within the scope of the invention and that obvious modifications may occur to a person skilled in the art.

DESCRIPTION OF THE PREFERRED EMBODIMENT

Figure 1:
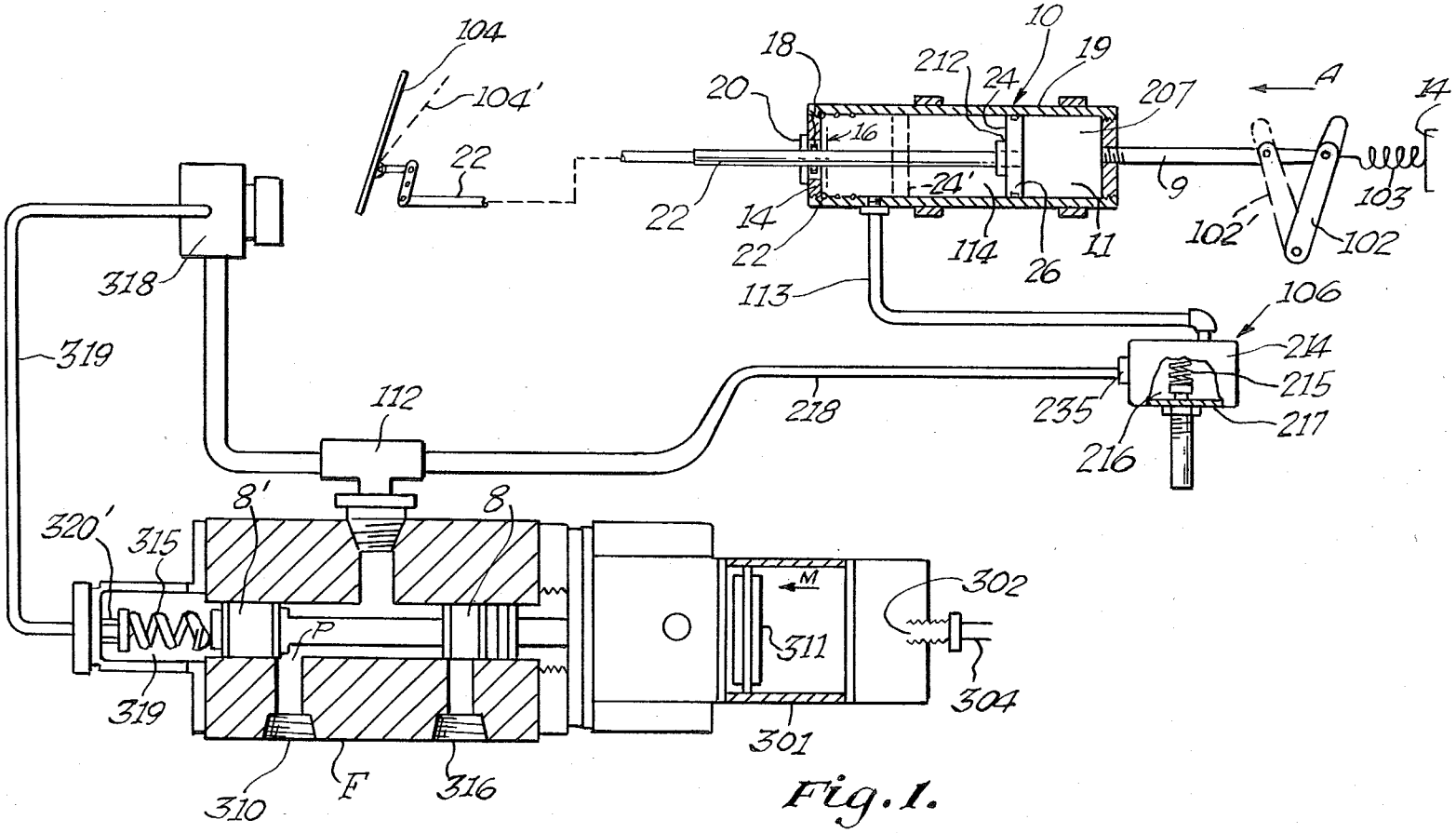
FIGS. 1 and 2 are partial sectional schematics showing the engine protection device with air pressure lines.

Referring now more particularly to the drawing in FIG. 1 the engine protection device and system 100 is used in association with an internal combustion engine, which includes a engine throttle level 102, moveable in a speed increase direction as shown by arrow A by a connecting throttle rod 9 connected to and actuated by operators control lever 104 by the rod 22 is connected between said control lever 104 and throttle rod 9. Between rod 22 and rod 9 is the engine protection device 10 controlled by the engine protection control system

106. The engine protection system 106 includes engine protection device 10 that shortens or lengthens the distance between operators control level 104 and throttle 102 to provide full range speed control or decreased speed control through movement of throttle 102.

The engine protection device 10 includes a relatively small diameter, elongated compressed air cylinder assembly 10. Said air cylinder assembly 10 includes a tubular body 12, threaded end plug 14, oil seal 22, a bushing 18 which is retained by snap rings 20. The piston 24 with O-ring 26 moves to the right under air pressure from line 113. The right end portion of the throttle rod 22 forms a piston rod or the piston 24. The piston rod is slidably positioned in sealed relation through the bushing 18, the inward end of rod 22 is attached to the piston 24. The left end portion of the throttle rod 9 is secured to the end plug in cylinder assembly 10. A return spring 103 is used to urge cylinder assembly 10 to the right to its idle position.

A first conduit 113 is attached to the air cylinder assembly to the left of the piston. A port 11 allows air to escape from 207. The pressurized air comes from oil pressure valve 4 through T-fitting 112 into line 218, through the normal open thermo cooling water valve 214 and into line 113.

The oil pressure valve 4 is in a normally closed position. Valve 4 is set to quickly open pressurized air inlet 310 at a prescribed predetermined oil pressure at oil inlet 302. The oil enters through line 304 and moves piston 311 to the left in chamber 301. Piston 311 moves when the oil pressure overcomes the force of spring 315, when piston 311 moves, it in turn shifts the spool valve 8 and 8' opening air inlet 310 and closing outlet 316. When spool valve 8 is moved into an open position it allows compressed air to move from 310 to point 317 and on to T-fitting 112. The pressurized air also moves through line 218 to control the cylinder assembly 10. Pressurized air from T-fitting 112 also moves to the inlet of pressure air regulator 318. This low pressure regulator will allow a reduced air pressure to exit through the small line 319 that feeds compressed air into chamber 319. This air pressure aids the biasing means 315 in moving piston 311 and spool valve 8 and 8' to the right. Spool 8' is closed and spool 8 is opened to allow air from line 218 to escape. The chamber 319 on the end of the oil pressure valve 4 is to provide very precise downshift. The preciseness can be regulated by shims 320 placed underneath the spring 315. The shims adjust the spring tension. Therefore the selected downshift air pressure can be practically any desired pressure that is needed in order to give the internal compression engine full protection. The oil pressure valve 4 may have an initial upshift of twenty psi regulated by the spring pressure at 315 and a downshift piston as low as 4 pounds per square inch (psi) and some as high as twenty psi.

Oil comes into the oil pressure valve 4 from the engine oil pump not shown under pressure at 302 and proceeds into chamber 301, and moves piston 311 to the position shown to make pedal 104 operable. Spool 8' is positioned as shown in an open condition allowing air under pressure from a tank and pump, not shown, past point P where the spool 8' is open. The pressurized air moves through 112 to regulator 318 such as C.A. Norgren Co., 5400 S. Delaware Street, Littleton, Colo. 70120, miniature relieving type general purpose regulator. Regulator 318 will let air pass into line 319 at a lower pressure. The pressure regulated air is added to chamber 319 after the spool valve is placed into the position shown. This places added pressure in opposition as shown by an arrow M. Spool 8' will move to the right when the oil pressure at 304 equals the pressure of spring 315 and that added air pressure in 319. This improved oil pressure valve provides an improved system because the pressure to the right on 311 after a very short time X allows a close downshift at the start pressure, for example twenty psi. In the past the piston 311 would for example, with a particular spring and shim setting move to the left at twenty psi but would move to the right only after an oil pressure drop to zero psi or five psi. A required drop down to about zero or five psi could allow operation and damage of the engine. By adding air pressure in 319 and using the shims one can calibrate the down shift so that the spools 8 and 8' move to the right at anywhere from twenty psi oil pressure down to 5. For example, one could have spools move to the left at twenty psi oil pressure and move to the right at eighteen psi. This provides better control of the oil pressure in the engine and provides shut down to idle the engine when low pressure occurs. For example, if one loses oil pressure all of a sudden in an engine and you want to reduce engine speed real fast when the engine pressure reaches eighteen pounds per square inch to bring the engine to an idle speed, this engine control device will perform the task. It will perform the task in a case where you get fuel oil dilution in a diesel engine, because the oil pressure will drop slowly. This control device will automatically place the throttle in idle when eighteen psi is reached.

When the running engine moves oil through the fuel pump puts to 304 into cavity 301 moving piston 311 to the left to the position shown in FIG. 1, pressurized air will flow from 310 past point P into T-fitting 112 to line 218 into the open hot water cooling system control valve, a shutter stat valve Model No. 36000 by Kysor Catlillac of Catlillac, Mich., and to the speed control cylinder 10. The air pressure from 310 is placed in body 12 to position the piston 24 connected to rod 22 at 212 in the running position with air under pressure to the left of the piston. That places the throttle 102 in the phantom 102' position. The engine can then be controlled by the foot pedal or throttle lever as shown at 104. If there is a loss in pressure to the set pressure, such as eighteen psi, piston 311 will move to the right under the force of spring 315 and the reduced pressure at 319. The shuttle valve 8 and 8' will move to the right cutting off the pressure air from 310 and open the exit to 316 to allow air pressure to be released to atmosphere. The pressure in line 218, shutter valve 214, line 113 and chamber 114 is reduced to cause the piston 24 in body 12 to move to the off position, placing the piston 24 into the phantom view position 24'. The foot pedal or throttle lever will move to the phantom position 104' and the throttle will move to the position 102. Body 19 will be pulled to that position by the contracting spring 103. The engine is brought to an idle speed and removes control over the engine speed from the operator. The operator cannot press the pedal or throttle lever down any further. Therefore the engine will be saved from overheating or running without proper oil pressure.

It should be noted that if only spring 10 were used at the left of the valve members 8 and 8', you would have to either have a soft spring to provide quick movement of the piston 311 to the left under oil pressure and slow movement back at zero to five psi to release the air pressure or you would have to install a heavy spring that would provide slow initial movement to the left at an unacceptable high pressure and a shift pressure moving the piston to the right. The present invention includes an additional air pressure through line 319 after a time delayed fromt the initial shift to the left so that close shift to the right may occur at a pressure close to the initial pressure.

An oil pressure valve 4 is connected to a source of hydraulic pressure on the engine and is used to regulate pressurized air flow through the protection device. The oil pressure valve 4 and the water temperature valve 214 are used to low idle the engine.

The water temperature or thermo valve 214, relieving type is attached by pipe thread to engine cylinder head or water manifold (not shown). The heat sensor of the thermo valve being immersed in engine water coolant. Air under pressure flows through conduit, into thermo valve which is normally open then through conduit and flexible conduit into the cylinder assembly 10. This air under pressure will entend the cylinder assembly into its working length. Should engine coolant temperature rise above predetermined level, valve will compress a spring 215 until the valve is firmly against its seat thereby stopping air flow to the cylinder assembly 10. Air trapped in the cylinder assembly 10 will flow through the system out exit 316. Air will enter exit 11 and the engine will be brought to idle or stop.

This invention is an improvement to U.S. Pat. No. 4,485,781 which disclosure is incorporated by reference into this application.

Figure 2:
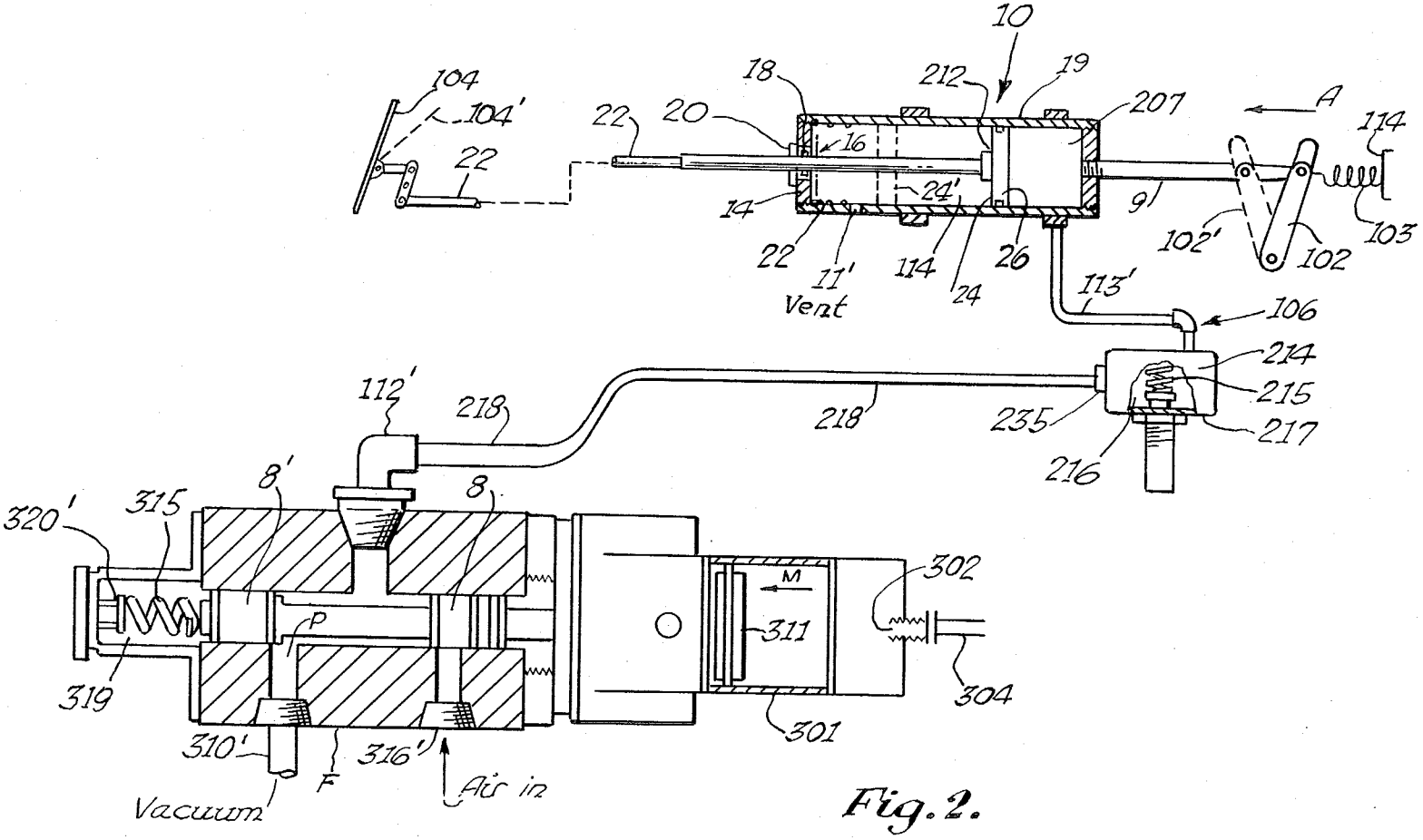

Referring to FIG. 2, when no pressurized air is available, the system may be designed to work on a vacuum. By connecting the vacuum source as 310' and allowing air to enter at 316', and changing the T-fitting to an elbow 112' and plugging the end of chamber 319 and modifying the device 10 is by connecting 113' into old port 11 in FIG. 1 and allowing port 11' to become a vent the system will operate. When vacuum is used instead of compressed air the downshifting will be close to the initial shifting pressure.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An engine protection device for controlling engine speed of an internal combustion engine comprising:

a throttle actuator means connectable to an engine speed regulator of an engine;

a variable link means including a piston and a piston housing, said throttle actuator means connected to one member of said variable link means and said other member connectable to the engine speed regulator, said variable link means including an inlet into said piston housing and said piston;

an oil pressure regulator including an engine oil inlet, a movable piston means in fluid communication with said oil inlet, a piston return means, a control member connected to said piston, said control member including valve means for opening and closing pressurized fluid source for access to and from said variable link means, said valve means including an inlet port connectable to a fluid pressure source, an exit port and an outlet port;

connecting means operably connected between said outlet port and inlet port and said inlet port of said variable link means;

a feedback system operably connected between said outlet port and inlet port and said return means for allowing said piston means to move and activate said throttle actuator means at one engine oil pressure and for providing a closing pressure to return said piston means by increasing total pressure of said return means after activation of said throttle actuator means.

2. An engine protection device for controlling engine speed of internal combustion engine as set forth in claim 1, wherein:

a sensing means connectable to the engine, said sensing means for sensing the increase in engine temperature; said sensing means is connected in series into said connecting means.

3. An engine protection device for controlling engine speed of internal combustion engine as set forth in claim 2, wherein:

said pressurized fluid is pressurized air.

* * * * *